US007374366B2

(12) United States Patent
Tasi

(10) Patent No.: US 7,374,366 B2
(45) Date of Patent: May 20, 2008

(54) WAVE GENERATOR

(76) Inventor: Chang-Hua Tasi, 235 Chung-Ho Box 8-24, Taipei (TW)

( * ) Notice: Subject to any disclaimer, the term of this patent is extended or adjusted under 35 U.S.C. 154(b) by 60 days.

(21) Appl. No.: 11/357,853

(22) Filed: Feb. 21, 2006

(65) Prior Publication Data

US 2007/0196177 A1 Aug. 23, 2007

(51) Int. Cl.
*E03C 1/08* (2006.01)

(52) U.S. Cl. ..... 405/79; 4/491; 222/189.07; 261/DIG. 22; 210/456; 239/428.5

(58) Field of Classification Search ..... 405/78; 4/491; 222/189.06, 189.07, 189.11; 261/DIG. 22; 210/418, 456; 239/428.5; D23/249
See application file for complete search history.

(56) References Cited

U.S. PATENT DOCUMENTS 3,138,332 A * 6/1964 Hinderer ..... 239/427
3,239,152 A * 3/1966 Bachli et al. ..... 239/431
3,684,191 A * 8/1972 Shames et al. ..... 239/428.5
5,114,072 A * 5/1992 Barhydt, Sr. ..... 239/428.5
5,184,641 A * 2/1993 Kuhn ..... 137/504
6,902,123 B2 * 6/2005 Grether et al. ..... 239/428.5
2006/0011748 A1 * 1/2006 Ferrari ..... 239/428.5
2006/0273203 A1 * 12/2006 Denzler ..... 239/428.5

* cited by examiner

*Primary Examiner*—Tara L. Mayo

(57) ABSTRACT

A wave generator comprises a seat; a positioning ring a wave generating unit received in an upper side of the seat; the wave generating unit being formed by a flow-steady base and a flow-collecting mask; the flow-steady base having a central platform; an upper surface of the central platform having a plurality of projecting blocks which are annularly arranged; the spaces between projecting blocks being formed as flow channels; an inner wall of the wave generating unit being formed with a plurality of longitudinal slots for draining water; a positioning unit for positioning the flow-steady base and the flow-collecting mask precisely; a filtering web having a plurality of holes which formed as an umbrella shape; a positioning rod extending from a central lower side of the web; and a front end of the positioning rod being formed an enlarged tapered head.

4 Claims, 7 Drawing Sheets

WAVE GENERATOR

FIELD OF THE INVENTION

The present invention relates to wave generators, and in particular to a wave generator in that, water sprays out with a higher density and sands in the water can be accumulated in an annular groove so that the water is clean and clear.

BACKGROUND OF THE INVENTION

The prior art wave generator has some disadvantages which will be described herein. The water channels of the flow-steady base must be aligned to the slots of the flow-collecting mask so that water can flow out. However no positioning structure is formed so that water flows through the flow-steady base and flow-collecting mask are hindered by the blocks at the flow-steady base. Thus, the density of water flowing out from the faucet is not so high as expected. Therefore, in assembly, the worker must take time to align the flow-steady base and flow-collecting mask. This will induce low yield ratio and high cost.

SUMMARY OF THE INVENTION

Accordingly, the primary object of the present invention is to provide a wave generator in that, water sprays out with a higher density and sands in the water can be accumulated in an annular groove so that the water is clean and clear.

To achieve above objects, the present invention provides a wave generator which comprises a seat; a positioning ring a wave generating unit received in an upper side of the seat; the wave generating unit being formed by a flow-steady base and a flow-collecting mask; the flow-steady base having a central platform; an upper surface of the central platform having a plurality of projecting blocks which are annularly arranged; the spaces between projecting blocks being formed as flow channels; an inner wall of the wave generating unit being formed with a plurality of longitudinal slots for draining water; a positioning unit for positioning the flow-steady base and the flow-collecting mask precisely; and a filtering web having a plurality of holes which formed as an umbrella shape; a positioning rod extending from a central lower side of the web; and a front end of the positioning rod being formed an enlarged tapered head.

The various objects and advantages of the present invention will be more readily understood from the following detailed description when read in conjunction with the appended drawing.

DETAILED DESCRIPTION OF THE INVENTION

Figure 1:
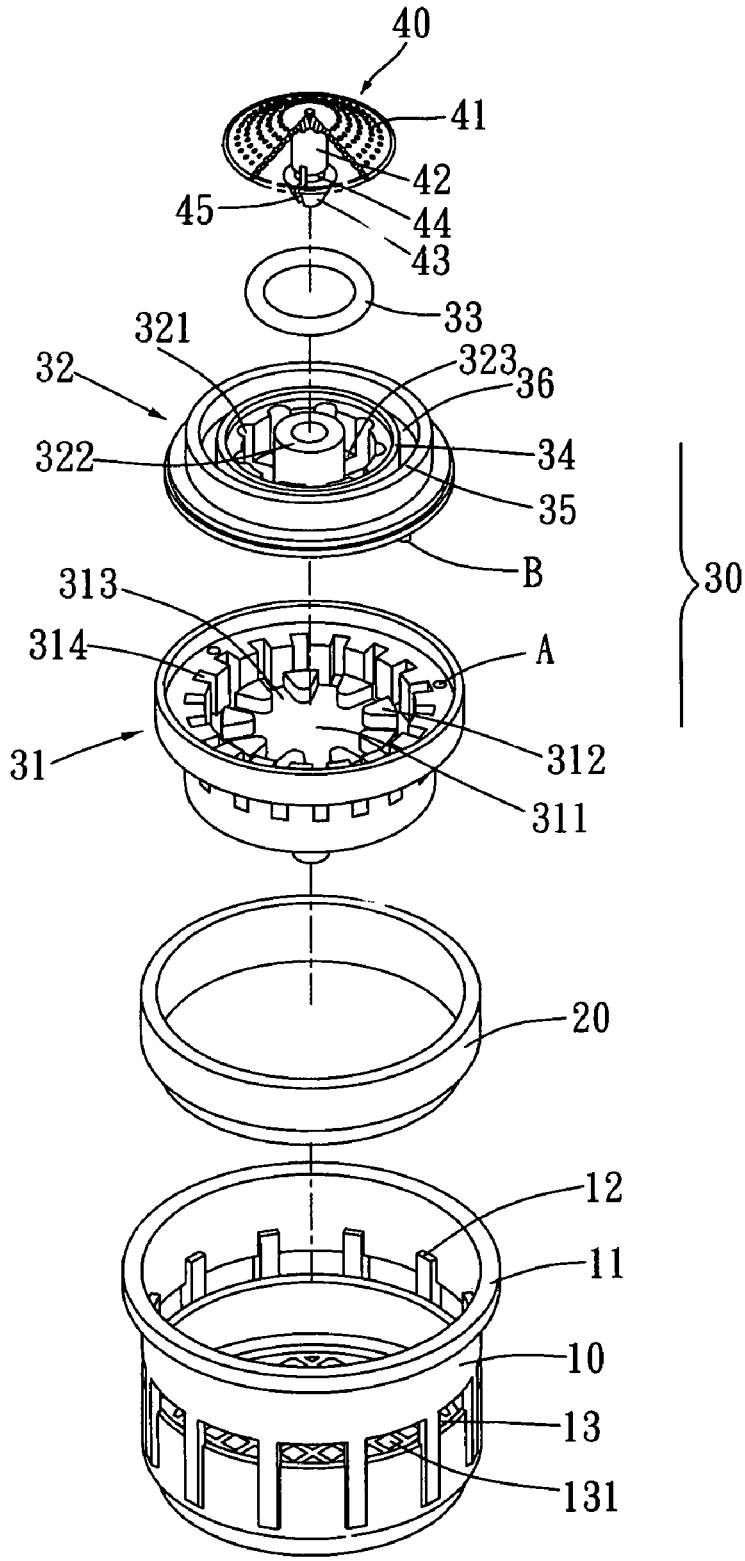
FIG. 1 is an exploded schematic view of the wave generator of the present invention.
Figure 2:
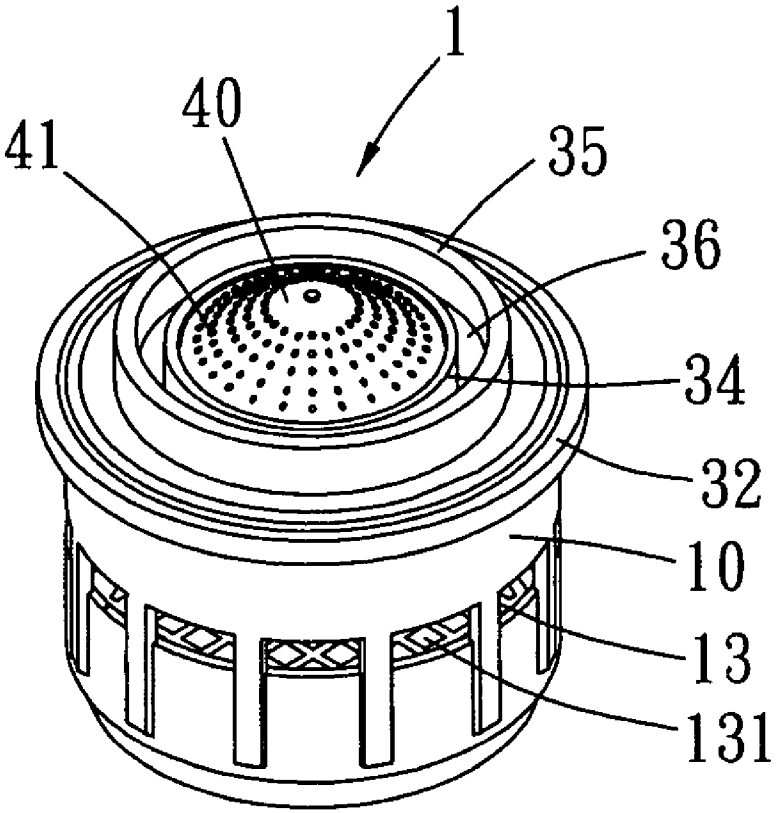
FIG. 2 is a schematic perspective view of the wave generator of the present invention.
Figure 3:
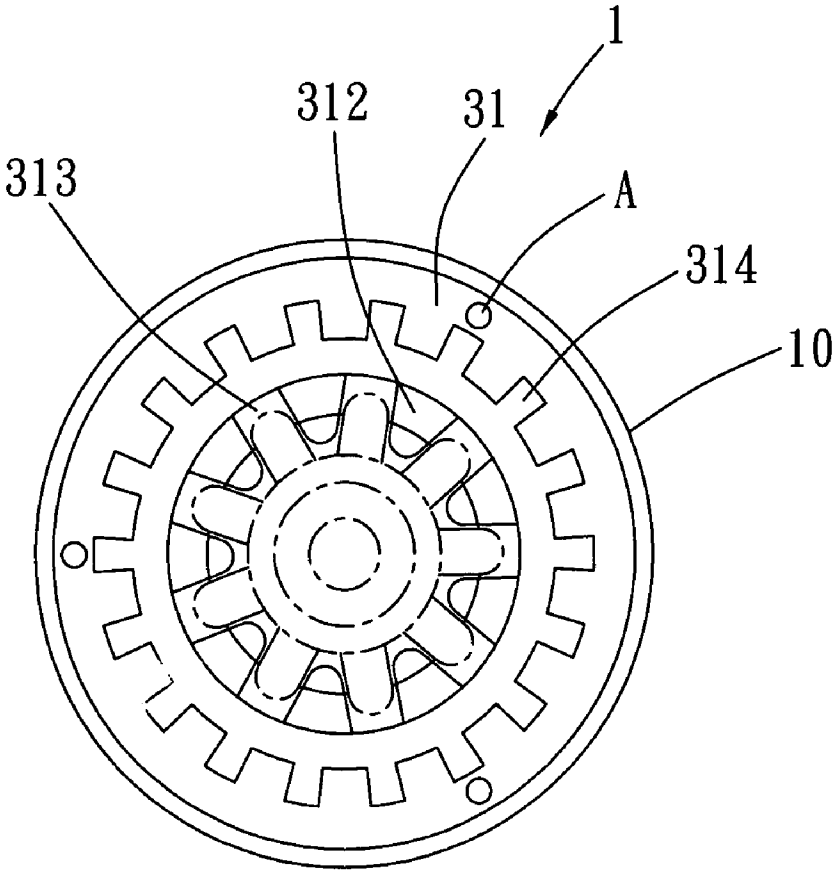
FIG. 3 is a plane schematic view about the wave generator of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

Referring to FIGS. 1 to 7, a wave generator used with a faucet according to the present invention is illustrated. The present invention has the following elements.

A seat 10 has an approximate U shape cross section. A top of the seat 10 is formed with a flange 11. An inner wall of the seat 10 is annularly arranged with a plurality of supporting blocks 12 which are spaced one by one. A bottom of the seat 10 is installed with a filter net 13. The filter net 13 has a plurality of net holes 131. Water flows through the net holes 131. The net holes 131 have various shapes.

A positioning ring 20 is a hollow annular structure. A lower side of the positioning ring 20 is reduced inwards so as to resist against the supporting blocks 12 of the seat 10.

A wave generating unit 30 is received in an upper side of the seat 10. The wave generating unit 30 is formed by a flow-steady base 31 and a flow-collecting mask 32. The flow-steady base 31 has an approximate T shape has a central platform 311. An upper surface of the central platform 311 has a plurality of approximately V shape blocks 132 which are annularly arranged. The spaces between the V shape blocks 32 are formed as flow channels 313. An inner wall of the wave generating unit 30 is formed with a plurality of longitudinal slots 314 for draining water.

The flow-collecting mask 32 is placed upon an upper side of the flow-steady base 31. The flow-collecting mask 32 has an inner wall 34 and an outer wall 35 enclosing the inner wall 34. An annular trench 36 is formed between the inner wall 34 and the outer wall 35. A center of the flow-collecting mask 32 has a central post 322. An inner side of the inner wall of the flow-collecting mask 32 is formed with a plurality of water slots 321 corresponding to the flow channels 313 of the flow-steady base 31. The number of the water slots 321 is equal to that of the flow channels 313. An annular groove 323 is formed between the central post 322 and the plurality of water slots 321. An O ring 33 encloses the central post 322

A positioning unit is formed in the present invention for positioning the flow-steady base 31 and the flow-collecting mask 32 precisely, as shown in FIG. 1. The positioning structure includes three positioning holes A at an upper surface of the flow-steady base 31 and three rods B at a lower surface of the flow-collecting mask 32 (The positioning structure may be formed by three rods at the upper surface of the flow-steady base 31 and three positioning holes at a lower surface of the flow-collecting mask 32). In another embodiment, as shown in FIG. 6, the positioning structure is formed by forming a cut surface C at an outer side of the flow-collecting mask 32 and the inner surface of the flow-steady base 31 is formed with a protrusion D corresponding to the cut surface C. Thereby the flow-steady base 31 can be engaged with the flow-collecting mask 32 by the protrusion D of the flow-steady base 31 to buckle into the cut surface C of the flow-collecting mask 32. Thus, the water slots 321 are aligned to the flow channels 313 of the seat (referring to FIGS. 3 to 7). Thus, the water can pass through the wave generating unit 30 from the sots 314. Water is densely sprayed out from the faucet.

A filtering web 40 has a plurality of holes 41 which formed as an umbrella shape. A positioning rod 42 extends from a central lower side of the web 40. A front end of the positioning rod 42 is formed with an enlarged tapered head 43. A round neck 44 is formed between the positioning rod 42 and the head 43. A later side of the tapered head 43 is formed with a slot 45. Thus, as the positioning rod 42 of the filtering web 40 passes through the stepped hole of the central post 322, the tapered head 43 can pass through the stop edge 3221 by the stop edge 3221 passing through the slot 45. Then the tapered head 43 resists against a lower end of the stop edge 3221. Thus the wave generator 1 of the present invention is formed.

Effect of the present invention will be described herein.

The three positioning holes A of the flow-steady base 31 are engaged to the three rods B of the flow-collecting mask 32. The flow channels 313 are aligned to the water slots 321 of the flow-collecting mask 32. Thereby water can flow successfully. Thereby the water spraying out from the faucet is dense. The water will not spray out disorderly. If the output water is too great, O ring 33 of the annular groove 323 will be pressed so that water flows out steadily and densely.

Figure 4:
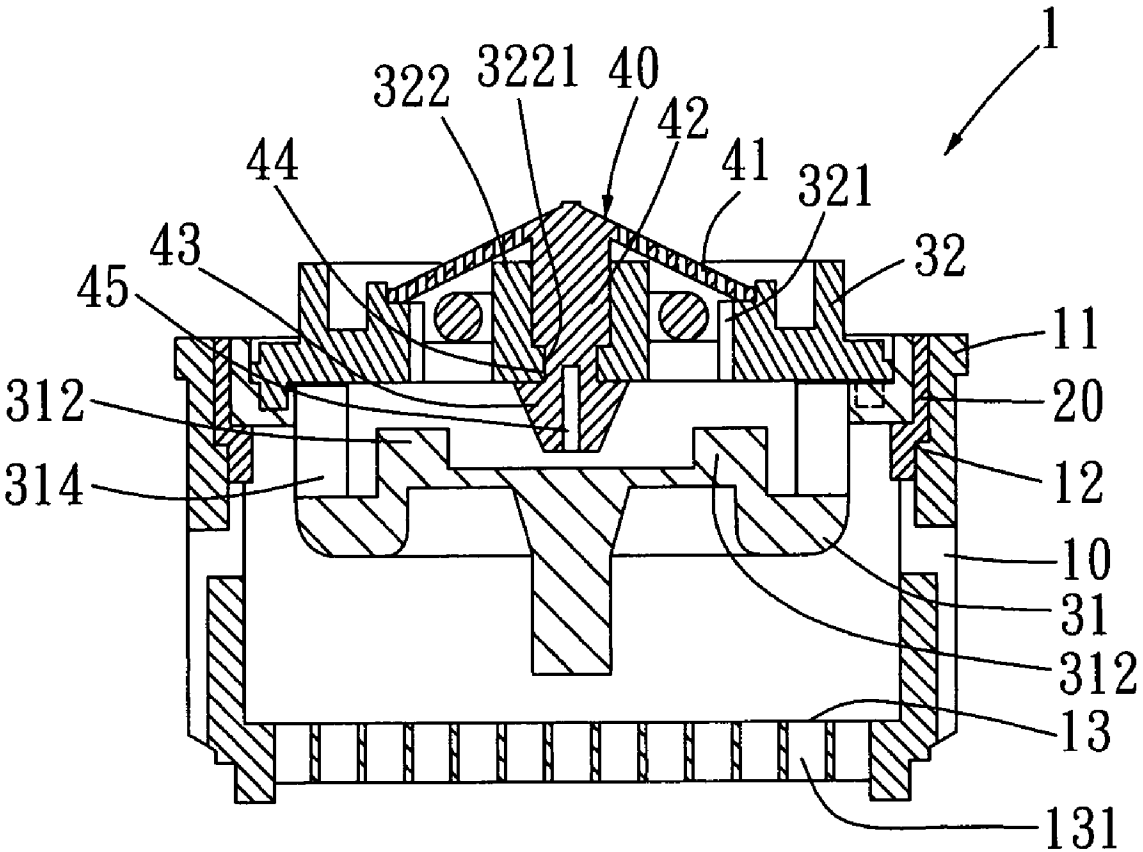
FIG. 4 is a schematic cross view of the wave generator of the present invention.

Furthermore, referring to FIG. 4, the tapered head 43 resists against the lower end of the stop edge 3221 of the central post 322 and the round neck 44 of the positioning rod 42 resists against a top surface of the stop edge 3221. Thereby if waterflow is too great, the filtering web 40 will not press downwards. Furthermore, by above-mentioned resisting effect, the filtering web 40 will not be pressed by great water flow. Thereby the positioning rod 42 resists against the central post 322, the O ring in the annular groove 323 will not fall out.

Figure 5:
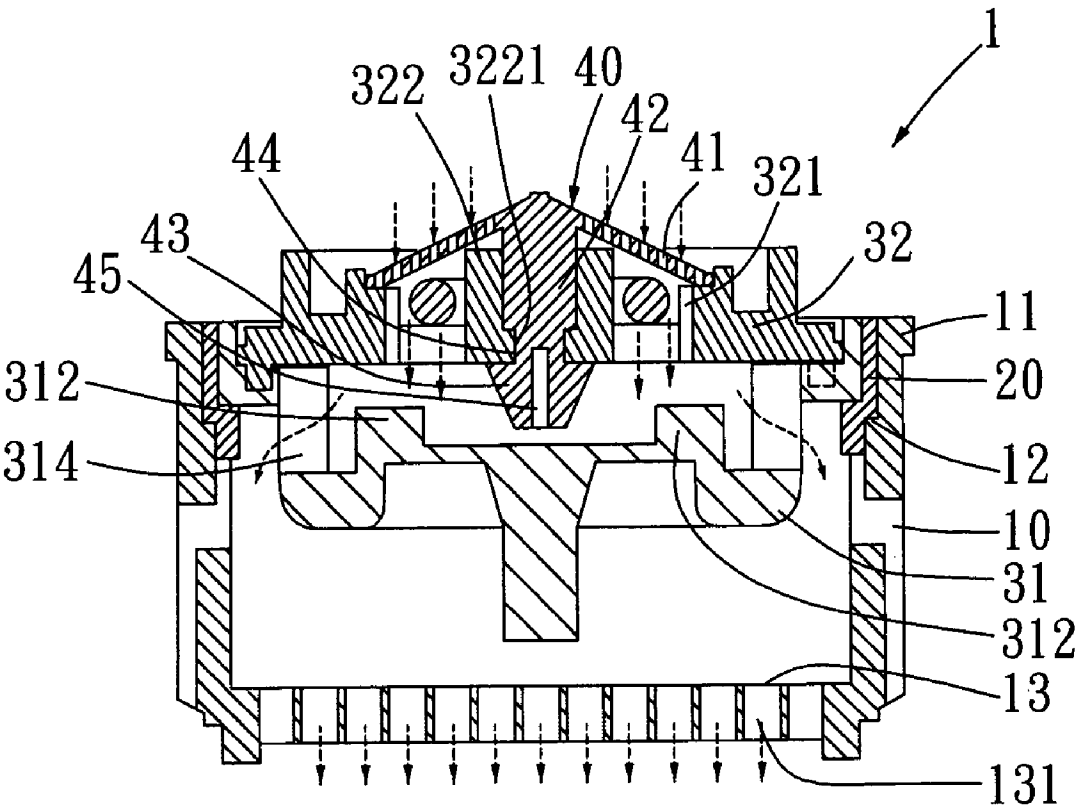
FIG. 5 is a schematic cross view of the present invention, where water flows through the wave generator.
Figure 6:
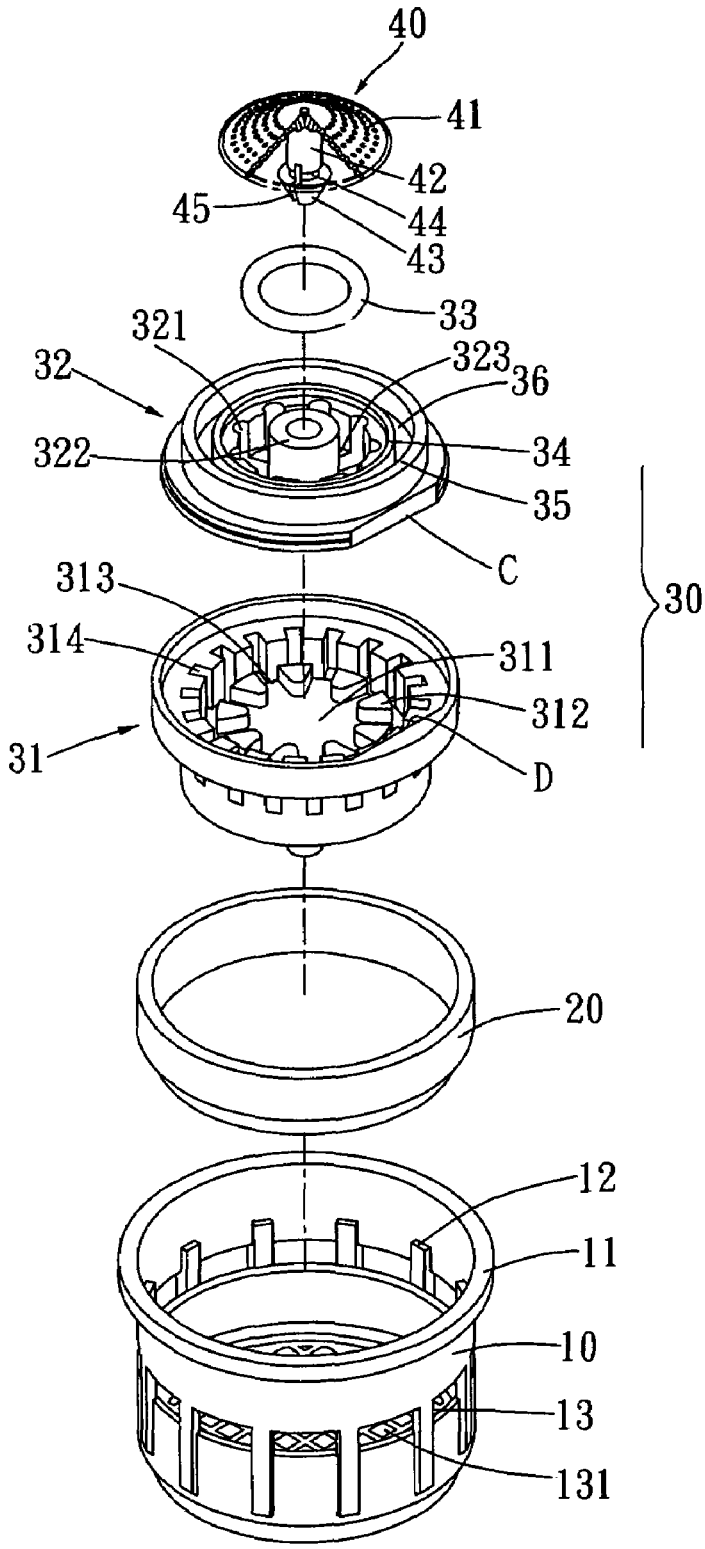
FIG. 6 is an exploded schematic view about the wave generator in the second embodiment of the present invention.
Figure 7:
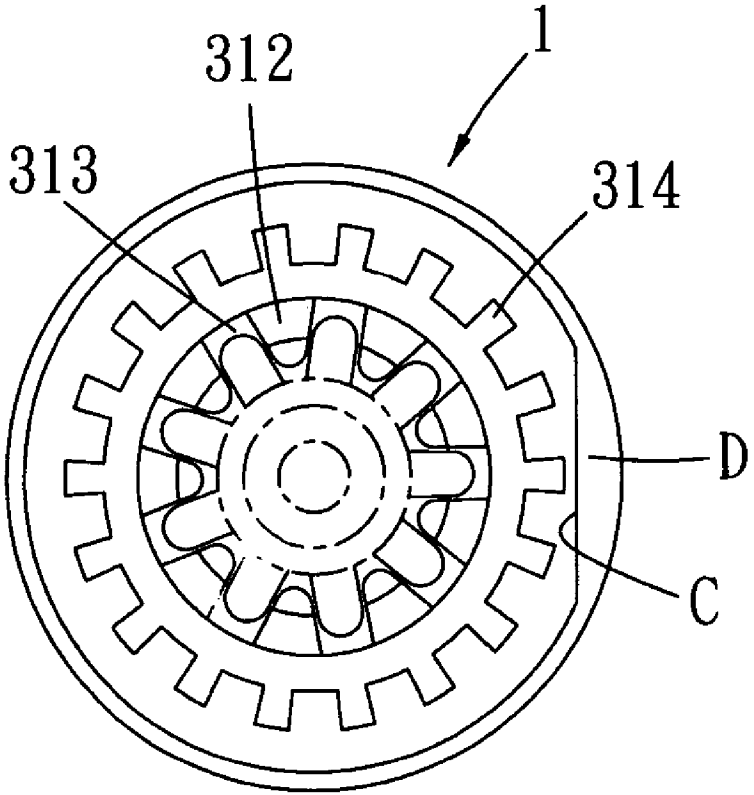
FIG. 7 is a plane schematic view about the wave generator of the second embodiment of the present invention.

Referring to FIGS. 4 and 5, when water flows through the filtering web 40, the sands in the water will not topped by the holes of the filtering web 40 and move to the annular trench 36 between the inner wall 34 and outer wall 35. Thus the output water is clear and clean.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A wave generator comprising:

a seat having an approximate U shape cross section; a top of the seat being formed with a flange; an inner wall of the seat being annularly arranged with a plurality of supporting blocks which are spaced one by one; a bottom of the seat being installed with a filter net; the filter net having a plurality of net holes; water flowing through the net holes;

a positioning ring being a hollow annular structure; a lower side of the positioning ring being reduced inwards so as to resist against the supporting blocks of the seat;

a wave generating unit being received in an upper side of the seat; the wave generating unit being formed by a flow-steady base and a flow-collecting mask; the flow-steady base having an approximate T shape and having a central platform; an upper surface of the central platform having a plurality of approximately V shape blocks which are annularly arranged; the spaces between the V shape blocks being formed as flow channels; an inner wall of the wave generating unit being formed with a plurality of longitudinal slots for draining water;

the flow-collecting mask being placed upon an upper side of the flow-steady base; the flow-collecting mask having an inner wall and an outer wall enclosing the inner wall; an annular trench being formed between the inner wall and the outer wall; a center of the flow-collecting mask having a central post; an inner side of the inner wall of the flow-collecting mask being formed with a plurality of water slots corresponding to the flow channels of the flow-steady base; the number of the water slots being equal to that of the flow channels; an annular groove being formed between the central post and the plurality of water slots; an O ring encloses the central post;

a positioning unit for positioning the flow-steady base and the flow-collecting mask precisely; and a filtering web having a plurality of holes which formed as an umbrella shape; a positioning rod extending from a central lower side of the web; a front end of the positioning rod being formed with an enlarged tapered head; a round neck being formed between the positioning rod and the head; a later side of the tapered head being formed with a slot; wherein as the positioning rod of the filtering web passes through the stepped hole of the central post, the tapered head can pass through the stop edge by the stop edge passing through the slot; then the tapered head resists against a lower end of the stop edge.

2. The wave generator as claimed in claim 1, wherein the positioning unit is formed by at least one positioning hole at a top surface of the flow-steady base and at least one protruded rod at a lower surface of the flow-collecting mask.

3. The wave generator as claimed in claim 1, wherein the positioning unit is formed by at least one protruded rod at a top surface of the flow-steady base and at least one positioning hole at a lower surface of the flow-collecting mask.

4. The wave generator as claimed in claim 1, wherein the positioning structure is formed by forming a cut surface at an outer side of the flow-collecting mask and the inner surface of the flow-steady base is formed with a protrusion corresponding to the cut surface.

* * * * *